US007183993B2

(12) United States Patent
Dai et al.

(10) Patent No.: US 7,183,993 B2
(45) Date of Patent: Feb. 27, 2007

(54) DIPOLE ANTENNA

(75) Inventors: Hsin-Kuo Dai, Tu-Chen (TW); Yun-Long Ke, Tu-Chen (TW); Lung-Sheng Tai, Tu-Chen (TW); Shu-Chen Yang, Tu-Chen (TW); Chin-Pao Kuo, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 8 days.

(21) Appl. No.: 11/026,149

(22) Filed: Dec. 29, 2004

(65) Prior Publication Data

US 2005/0231437 A1 Oct. 20, 2005

(30) Foreign Application Priority Data

Apr. 16, 2004 (TW) ..... 93110611 A

(51) Int. Cl.
*H01Q 9/28* (2006.01)

(52) U.S. Cl. ..... 343/795; 343/797

(58) Field of Classification Search ..... 343/795, 343/797

See application file for complete search history.

(56) References Cited

U.S. PATENT DOCUMENTS 4,097,868 A * 6/1978 Borowick ..... 343/727
4,205,317 A 5/1980 Young
5,936,590 A * 8/1999 Funder ..... 343/795
6,072,439 A * 6/2000 Ippolito et al. ..... 343/797
6,163,306 A 12/2000 Nakamura et al.
6,239,764 B1 * 5/2001 Timofeev et al. ..... 343/795
6,285,336 B1 * 9/2001 Zimmerman ..... 343/803
6,650,301 B1 11/2003 Zimmerman
6,816,124 B2 * 11/2004 Tillery ..... 343/797

* cited by examiner

*Primary Examiner*—Tho Phan
(74) *Attorney, Agent, or Firm*—Wei Te Chung

(57) ABSTRACT

A dual-band antenna for communication device includes a first dipole antenna, a second dipole antenna and a coaxial feed line. The first dipole antenna includes a first radiating element disposed at a first plane and a first ground portion disposed at a second plane. The second dipole antenna includes a second radiating element disposed at a first plane and a second ground portion disposed at a second plane. The feed line includes an inner conductor electrically connecting to the first and second radiating elements and an outer conductor electrically connecting to the first and second ground portions. The first and second radiating elements both further include a compensating portion for improving radiating patterns of the first and second dipole antennas and a broadband portion for increasing frequency bands of the first and second dipole antennas.

19 Claims, 9 Drawing Sheets

DIPOLE ANTENNA

BACKGROUND OF THE INVENTION

1. Field of the Invention

The present invention relates generally to an antenna, and more particularly to a dipole antenna for a wireless communication device.

2. Description of the Prior Art

A dipole antenna is a straight electrical conductor measuring ½ wavelength from end to end and connected at the center to a radio frequency (RF) feed line. This antenna, also called a doublet, is one of the simplest types of antenna, and constitutes the main RF radiating and receiving element in various sophisticated types of antenna. The dipole is inherently a balanced antenna, because it is bilaterally symmetrical. According to that, the dipole antenna exhibits a symmetric radiation pattern. A symmetric radiation pattern provides uniform gain in 360 degrees, thereby allowing equally effective communication in all directions. However, the radiation distance is limited by power supplied to the antenna, so if we want to realize far-distance communication in all direction, adding power supply is needed. Base station antennas used in wireless communication systems adopt dipole antennas mostly along with high power transmitter.

In additional to be used in base station, dipole antennas can also be used in other fields. Especially in these years, with the development of wireless local area network (WLAN), dipole antenna finds its new application. It is well known that the efficient radiating radius of WLAN covers the range of 30 to 300 meters in which an omni-direction antenna (such as dipole antenna) will be an optional choice to engineers. U.S. Pub. No. 2004/0080464 published to Suganthan et al. on Apr. 29, 2004 and entitled "Dual band single feed dipole antenna and method of making the same" discloses a dual band single center feed dipole providing a single band dipole antenna and loading the single band dipole antenna with two open circuit stubs or arms forming a second half-wave dipole. The antenna is printed antenna structure, which can be integrated with other microelectronic devices on a substrate. Here, another dipole antenna formed of metallic sheets is provided, which has a compact construction and is used for industrial scientific medical ("ISM") band operation covering, for example, frequency range of 2.4–2.5 GHz and 5.15–5.35 GHz.

BRIEF SUMMARY OF THE INVENTION

It is an object of the present invention to provide a dual band dipole antenna, which has a low profile construction and can be manufactured easily.

To achieve the aforementioned object, the present invention provides a dual-band antenna which has two dipoles. The first dipole antenna comprises a first radiating element disposed at a first plane and a first ground portion disposed at a second plane. The second dipole antenna comprises a second radiating element disposed at the first plane and a second ground portion disposed at the second plane. The first and the second radiating elements are formed of a first member and the first and second ground portions are formed of a conjugated member. The first member has the same shape and dimension as that of the conjugated member. Therefore, when the first member is fabricated, the conjugated member is fabricated as well, and thus manufacture time and costs will be reduced. The first and second radiating elements both further consist a compensating portion for improving radiating patterns and a broadband portion for improving resonating bandwidth of the first and second dipole antennas. A feed line has its inner conductor connect to radiating elements and outer conductor connect to ground portions.

Additional novel features and advantages of the present invention will become apparent by reference to the following detailed description when taken in conjunction with the accompanying drawings.

DETAILED DESCRIPTION OF THE INVENTION

Reference will now be made in detail to a preferred embodiment of the present invention.

Figure 1:
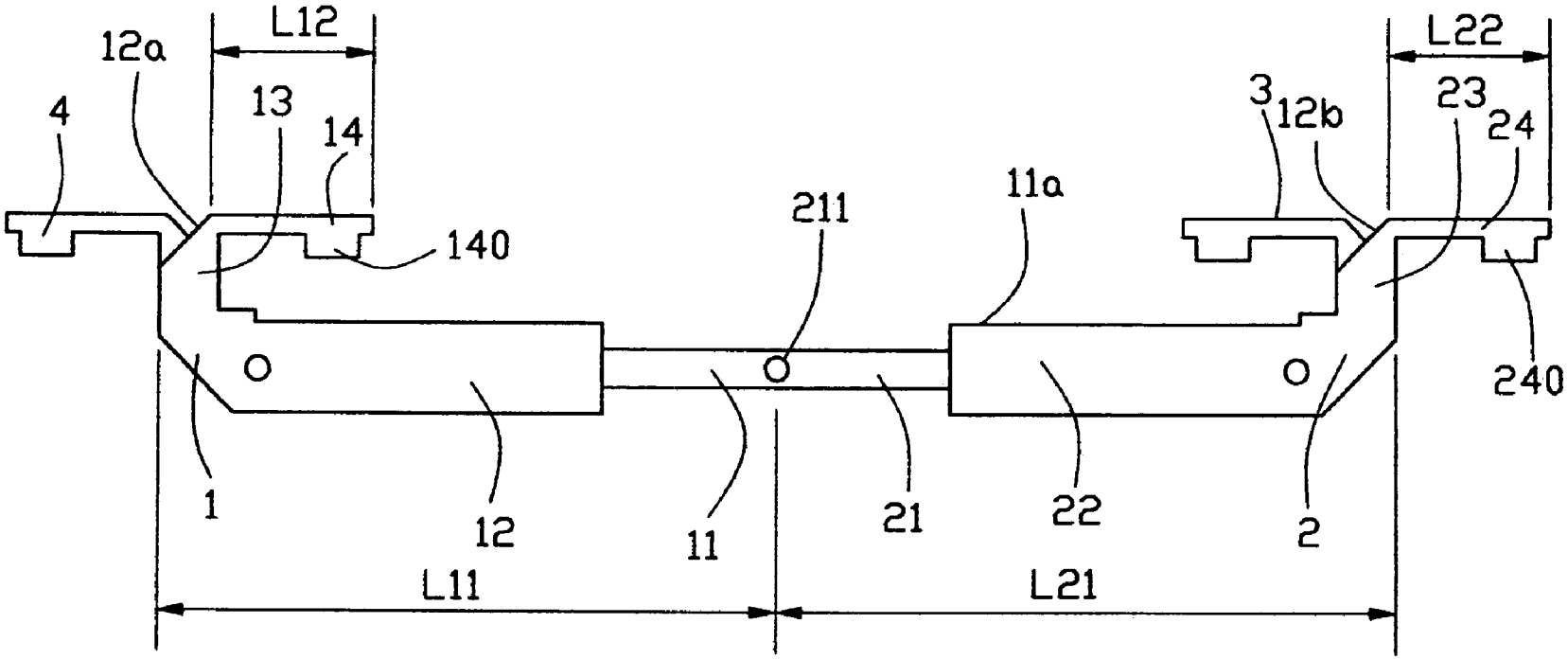
FIG. 1 is a top view of a dual-band antenna in accordance with the present invention.
Figure 2:
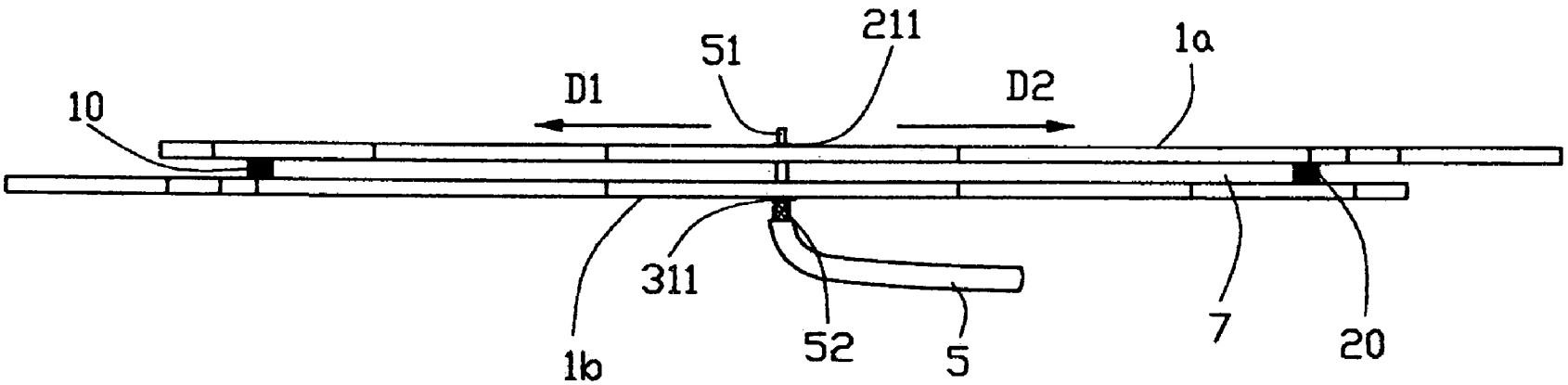
FIG. 2 is a side view of the dual-band antenna in accordance with the present invention.

Referring to FIG. 1 and FIG. 2, a dual-band antenna 6 in accordance with a preferred embodiment of the present invention is constituted by forming a first and second dipole antenna each having a radiating element 1, 2 and a ground portion 3, 4 and a feed line 5 coupled to the dipole antennas through welding holes 211, 311. In order to assemble the above-described antenna, the radiating elements 1, 2 are formed integrally as a first member 1*a*, while the ground portions 3, 4 are formed integrally as a conjugated member 1*b* with respect to the first member 1*a*. The first member 1*a* and conjugated member 1*b* are parallel to each other and arranged in two different planes.

The first member 1*a* and the conjugated member 1*b* are identical in construction and thus only the first member 1*a* will be described in detail. The first member 1*a* comprises a first base member 11*a*, and a pair of radiating terminal parts 12*a*, 12*b* extending from opposite ends of the first base member 11*a* along a same direction. The welding hole 211 is located centrally in the first base member 11*a* to aid in connecting the first member 1*a* to a conductor 51 of the feed line 5. The welding hole 211 separates the first member 1*a* into first and second radiating elements 1, 2. The first radiating element 1 consists of an elongated portion 11, a broadband potion 12, a compensating portion 13 and a free portion 14, and the second radiating element 2 likewise consists of the aforementioned four kinds of portions, respectively designated with reference numbers 21, 22, 23 24. The elongated portions 11, 21 and broadband portions 12, 22 arranged in one line constitute the first base member 11*a*. The broadband portions 12, 22, which are used for increasing the bandwidth of the antenna 6, each have a greater width than those of the elongated portions 11, 21. The compensating portion 13 and the free portion 14 constitute the first radiating terminal part 12*a*, and the other compensating portion 23 and free portion 24 constitute the second radiating terminal part 12*b*. The two terminal parts 12*a*, 12*b* have the same shape and dimension and thus only the first terminal part 12*a* will be described in detail. The compensating portion 13 of the first terminal part 12*a* extends from the first base member 1*a* and is used for improving the radiating patterns of the antenna. The free portion 14 extends orthogonally from the compensating portion 13 but is parallel to the first base member 11*a*. A protruding section 140 is located adjacent to the end of the free portion 14 towards the first base member 11*a*.

As can be seen from FIG. 1, the first radiating element 1 is approximately shaped like inverted-U and the second radiating element 2 is approximately shaped like inverted-Z. The first radiating element 1 and the second radiating element 2 each have first and second physical lengths L1 and L2, and electrical lengths L3 and L4. The length of L1 is equal to total length of L11 and L12, and the length of L2 is equal to total length of L21 and L22. The length of L3 is equal to L11 and the length of L4 is equal to total length of L21 and L22. As a result, the physical lengths of the first and second radiating element 1, 2 are the same, but the electrical lengths are different. As would be understood by those skilled in the art, the first and second electrical lengths L3 and L4 are tuning parameters of the antenna. In the embodiment of the present invention, the electrical length of the first radiating element L3 is determined based upon a quarter of a wavelength attained at the first operating frequency of 2.4 GHz and the electrical length of the second element L4 is determined based upon a quarter of a wavelength attained at the second operating frequency of 5.2 GHz.

As can be seen from FIG. 1 and FIG. 2, the first radiating element 1 extends along a first direction D1, and the second radiating element 2 extends along a second, opposite direction D2, both of which extend from the welding hole 211. The first ground portion 3 extends along the second direction D2, and the second ground portion 4 extends along the first direction D1, both of which extend from the other welding hole 311 in the conjugated member 1*b*. The first radiating element 1 and ground portion 3 constitute the first dipole antenna and the second radiating element 2 and ground portion 4 constitute the second dipole antenna. The feed line 5 in this embodiment is a coaxial cable, which has an inner conductor 51 soldered to the welding hole 211 and an outer conductor 52 soldered to the other welding hole 311. The welding holes 211, 311 are face to face, and thus the coaxial cable can pass through the holes easily for supplying power to the antenna 6.

Referring to FIG. 2, the first member 1*a* and conjugated member 1*b* have the same dimension and shape, which are formed of metallic sheets. The conjugated member 1*b* is in adjacent, spaced-apart relationship with the first member 1*a*. The conjugated member 1*b* can be regard as another first member, which rotates round the welding hole in a horizontal plane. The conjugated member 1*b* has a conjugated base member (not labeled) overlapped with respect to the first base member 11*a* and conjugated radiating terminal parts (not labeled). As constructed like that, a gap 7 is formed between the first base member 11*a* and conjugated base member (not labeled). Due to the first member 1*a* and conjugated member 1*b* have the same base configuration, the manufacture of the antenna 6 will be simple and low-cost. Two dielectric backstops 10, 20 are provided in the vicinity of the end of the first member 1*a* and conjugated member 1*b* to support the first member 1*a*.

Figure 3:
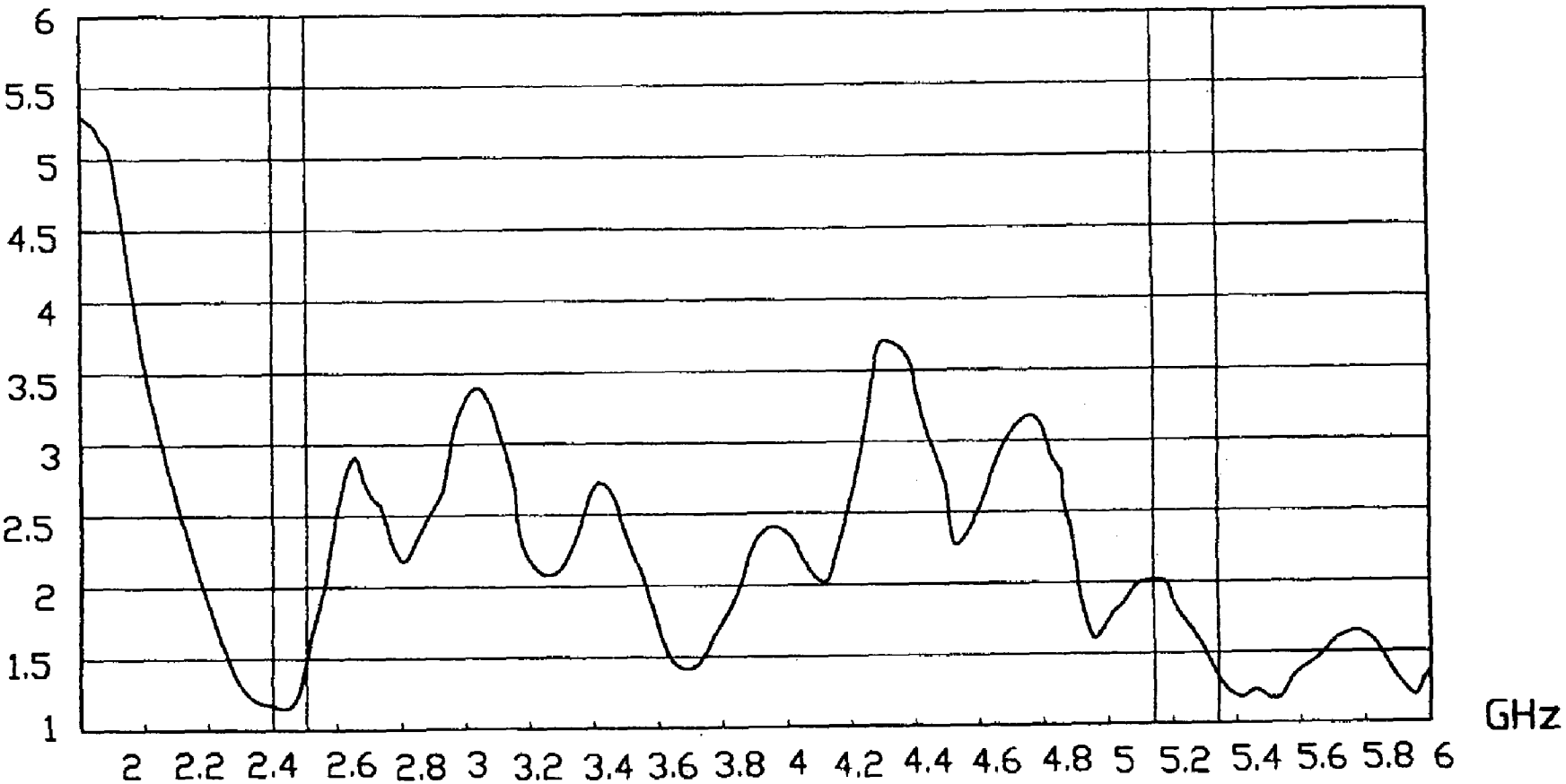
FIG. 3 is a test chart recording for the dual-band antenna of FIG. 1, showing Voltage Standing Wave Ratio (VSWR) as a function of frequency.
Figure 4:
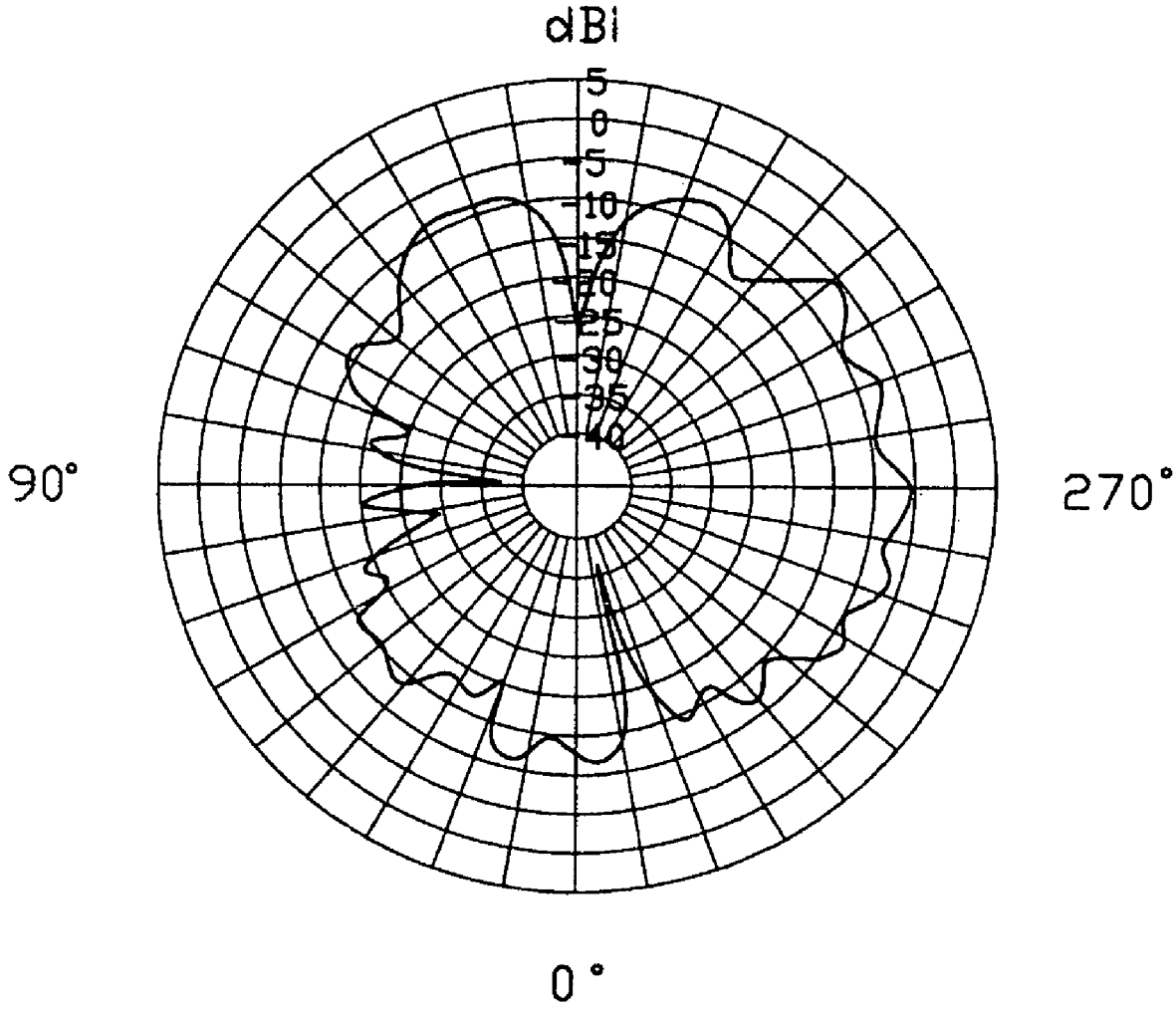
FIG. 4 is a horizontally polarized principle plane radiation pattern (where the principle plane is an X-Y plane) of the dual-band antenna of FIG. 1 operating at a frequency of 2.45 GHz.
Figure 5:
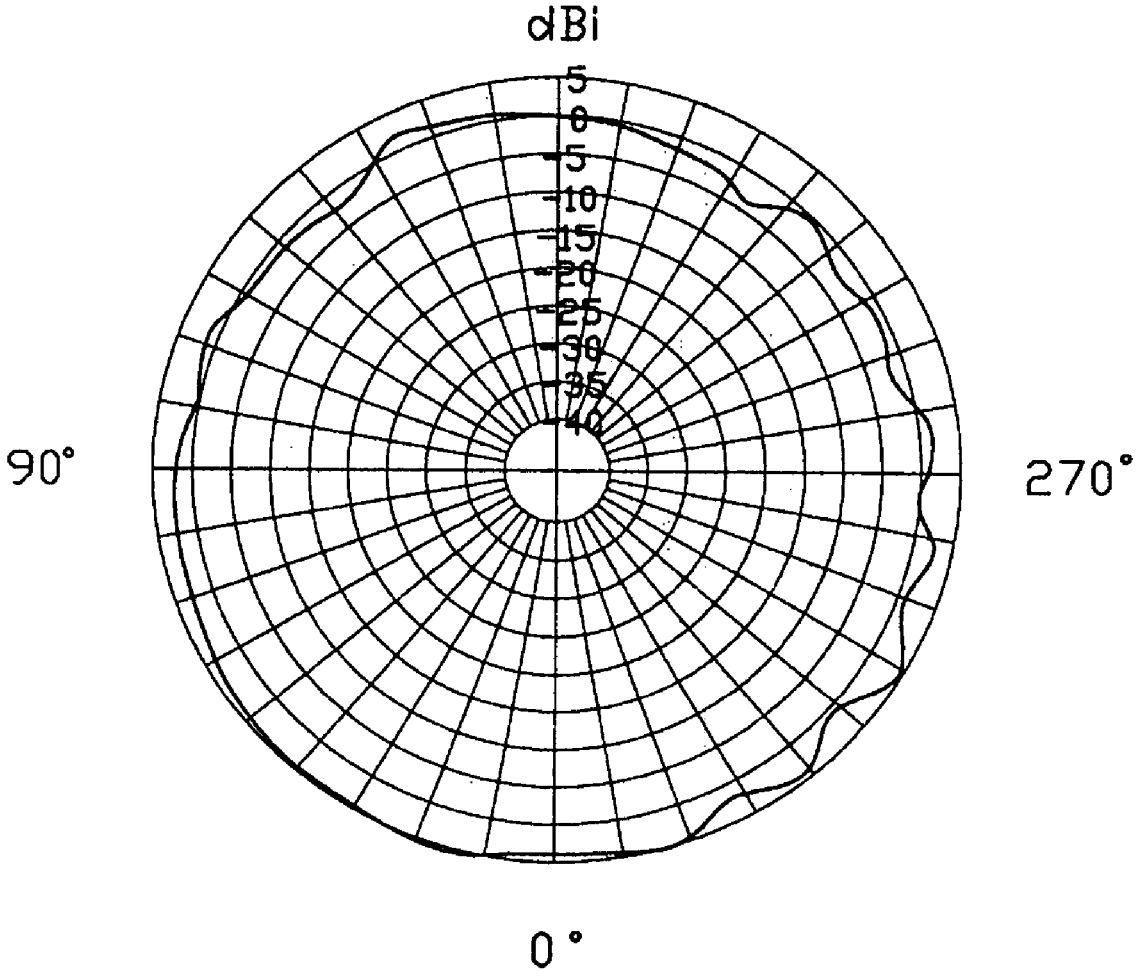
FIG. 5 is a vertically polarized principle plane radiation pattern (where the principle plane is an X-Y plane) of the dual-band antenna of FIG. 1 operating at a frequency of 2.45 GHz.
Figure 6:
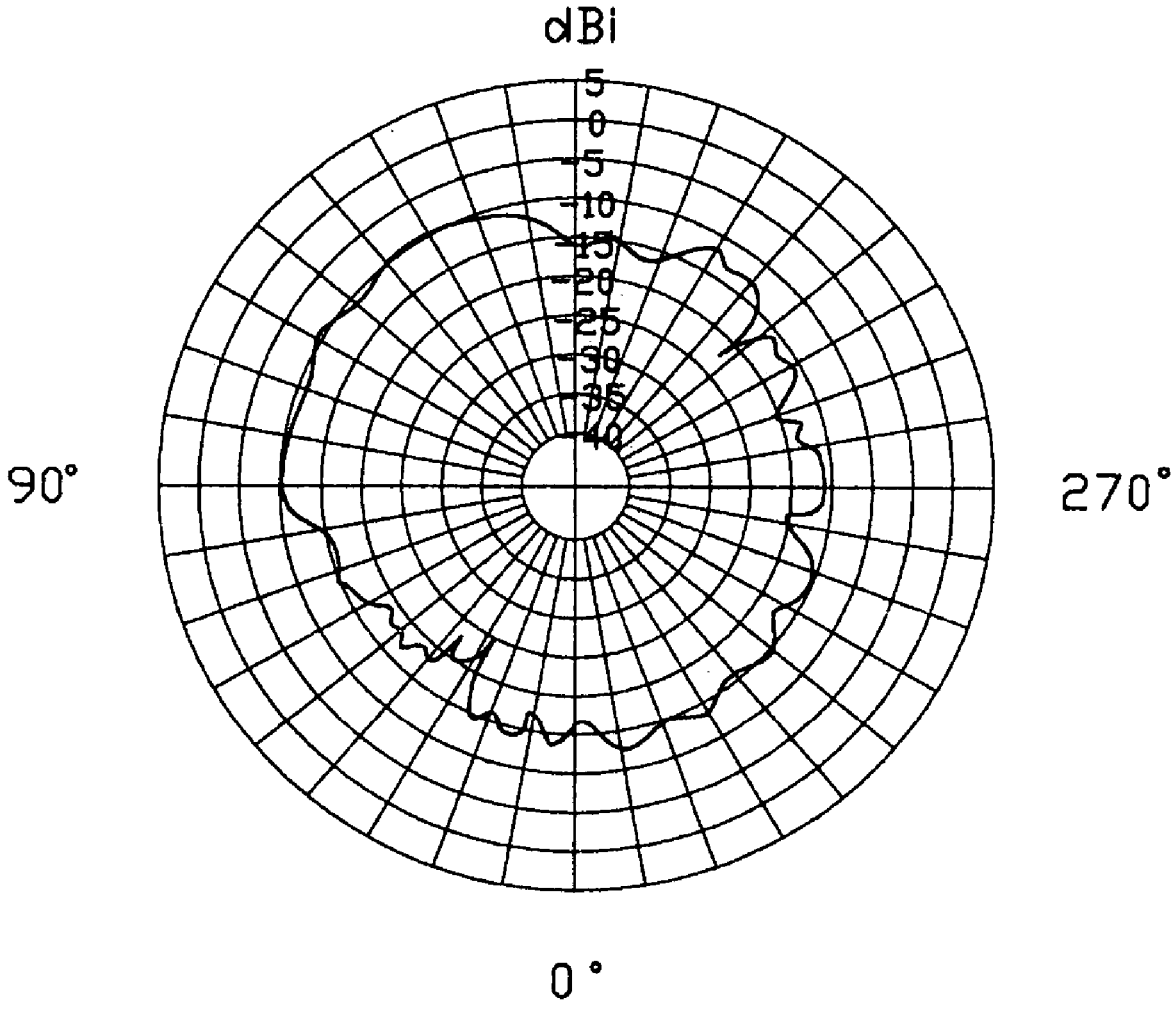
FIG. 6 is a horizontally polarized principle plane radiation pattern (where the principle plane is an X-Y plane) of the dual-band antenna of FIG. 1 operating at a frequency of 5.35 GHz.
Figure 7:
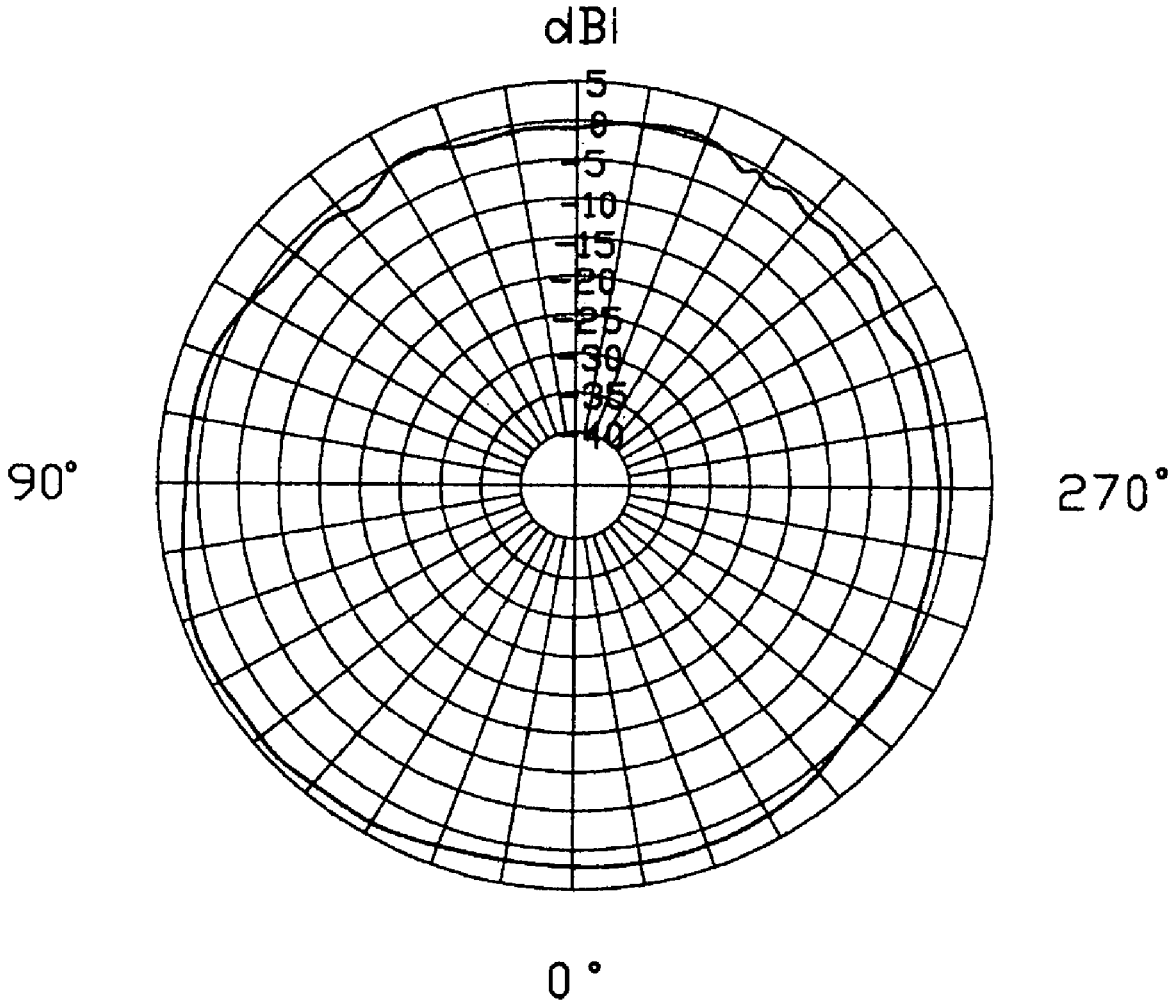
FIG. 7 is a vertically polarized principle plane radiation pattern (where the principle plane is an X-Y plane) of the dual-band antenna of FIG. 1 operating at a frequency of 5.35 GHz.
Figure 8:
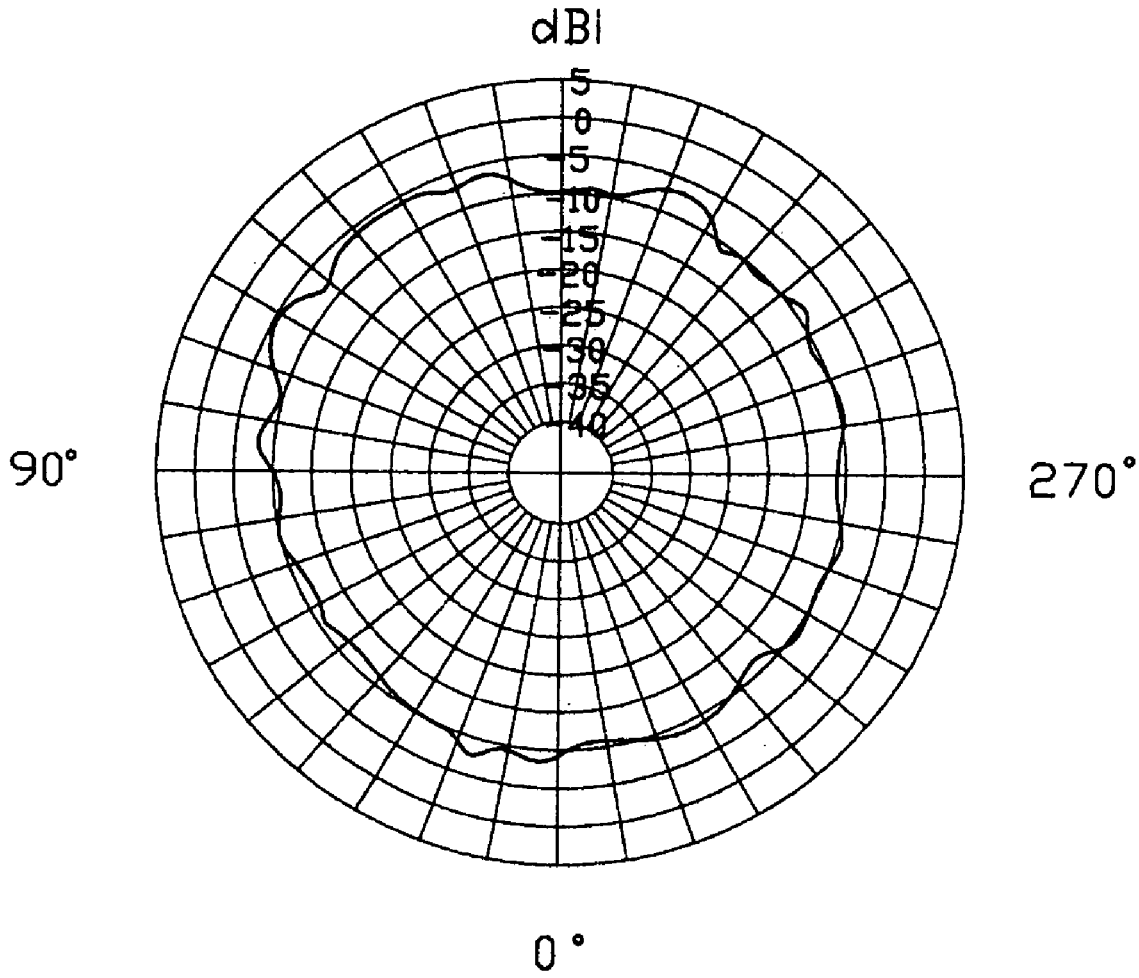
FIG. 8 is a horizontally polarized principle plane radiation pattern (where the principle plane is an X-Y plane) of the dual-band antenna of FIG. 1 operating at a frequency of 5.725 GHz.
Figure 9:
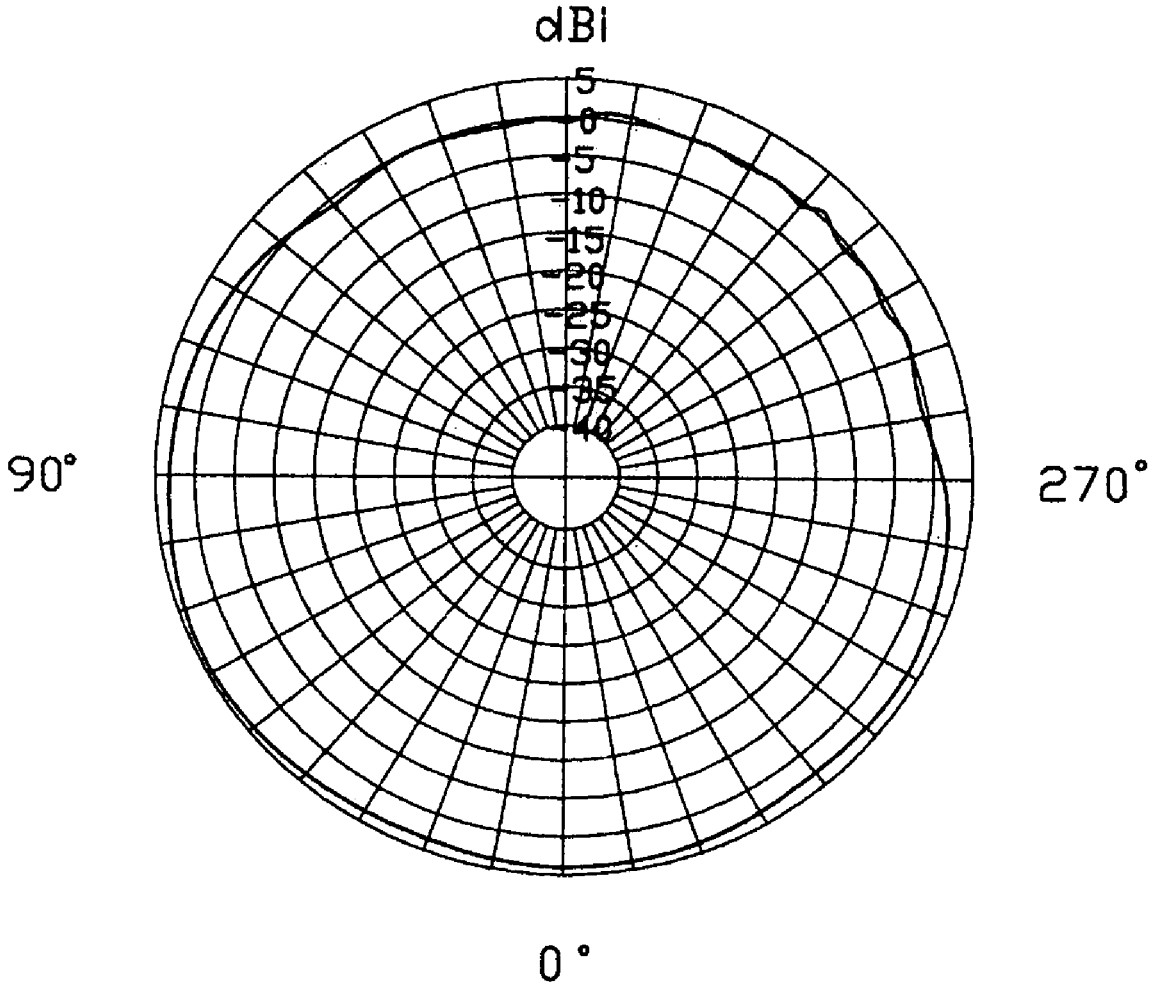
FIG. 9 is a vertically polarized principle plane radiation pattern (where the principle plane is an X-Y plane) of the dual-band antenna of FIG. 1 operating at a frequency of 5.725 GHz.

Referring to FIG. 3, a test chart of Voltage Standing Wave Ratio (VSWR) of the dual band antenna in FIG. 1 and FIG. 2. The central frequency of the first resonant frequency band is around 2.4 GHz, and the second resonant frequency band is around 5.5 GHz. Furthermore, under the definition of the VSWR less than 2, the bandwidth of the first resonant frequency and that of the second resonant frequency cover 2.2–2.6 GHz and 4.9–6.0 GHz, respectively. The two frequency bands are so wide that cover the bands for Wireless Local Area Network (WLAN) under IEEE 802.11a/b/g.

FIGS. 4–9 respectively show horizontally and vertically polarized principle plane radiation patterns of the antenna operating at frequencies of 2.45 GHz, 5.35 Ghz and 5.725 Ghz. Note that each radiation pattern is close to a corresponding optical radiation pattern.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A dual-band antenna comprising:

a first dipole antenna having a first radiating element disposed at a first plane and a first ground portion disposed at a second plane;

a second dipole antenna having a second radiating element disposed at said first plane and a second ground portion disposed at said second plane;

said first and second radiating elements connected to each other together with said first and second ground portions connected to each other; and a feed line having one conductor connected electrically to both said first and second radiating elements and the other conductor connected electrically to both said first and second ground portions; and wherein said first radiating element and said second radiating element extend away firstly from each other in opposite directions, and then extend in same direction, respectively.

2. The antenna as claimed in claim 1, wherein said first and second radiating elements have the same physical trace length but different electrical lengths.

3. The antenna as claimed in claim 1, wherein said first radiating element is constructed in a substantially inverted-U shape, and said second radiating element is constructed in a substantially inverted-Z shape.

4. The antenna as claimed in claim 1, wherein said first and second radiating element each comprise an elongated portion, a broadband portion, which is wider than said elongated portion, a compensating portion and a free portion.

5. The antenna as claimed in claim 4, wherein broadband portions are provided for increasing the bandwidth of said first and second dipole antenna, and compensating portions are perpendicular to corresponding broadband portions and are provided for improving the radiating patterns of said first and second dipole antennas.

6. The antenna as claimed in claim 4, wherein said first free portion and second free portion extend perpendicularly from respective compensating portions in same direction.

7. The antenna as claimed in claim 4, wherein said first free portion and second free portion each have a protruding section adjacent to the end of said first and second free portion.

8. The antenna as claimed in claim 1, wherein said first radiating element and first ground portion as well as said second radiating element and second ground portion are identical in construction.

9. The antenna as claimed in claim 1, wherein said radiating elements are parallel to said ground portions.

10. The antenna as claimed in claim 1, wherein both radiating elements and ground portions are in inverted-mirror-image relationship.

11. A dual-band antenna comprising:

a first member including a first base member, and radiating terminal parts extending from the first base member;

a conjugated member arranged with respect to said first member and having a conjugated base member and conjugated radiating terminal parts, said conjugated base member being juxtaposed with respect to said first base member;

a feed line interconnected with said first and conjugated member through their base member;

wherein said first member and said conjugated member have the shape and dimension, and said first base member and conjugated base member are arranged with a gap.

12. The antenna as claimed in claim 11, wherein said radiating terminal parts of said first member extend from said first base member in a first direction and said conjugated radiating terminal parts of said conjugated member extend from said conjugated base member in a second direction.

13. The antenna as claimed in claim 12, wherein said first direction and second direction are opposite to each other.

14. The antenna as claimed in claim 11, wherein said first base member comprises elongated portions, and broadband portions extending from and having greater width than said elongated portion.

15. The antenna as claimed in claim 11, wherein said radiating terminal parts of said first member have the same dimension and shape, each of which consists of a compensation portion and a free portion.

16. The antenna as claimed in claim 15, wherein said free portion is perpendicular to said compensating portion and parallel to said first base member.

17. The antenna as claimed in claim 11, wherein said first member and conjugated member are positioned in different planes but parallel to each other.

18. A dual-band antenna comprising:

spaced first and second plates;

a first dipole antenna including a first radiating element on the first plate and a first ground portion on the second plate;

a second dipole antenna including a second radiating element on the first plate and a second ground portion on the second plate; wherein the first plate and the second plate are similar to each other while the first dipole antenna and the second dipole antenna are dissimilar to each other; wherein the first radiating element and the first ground portion are similar to each other, and the second radiating element and the second ground portion are similar to each other.

19. The dual-band antenna as claimed in claim 18, wherein the first radiating element is closer to the second grounding portion than to the first grounding portion, and the second radiating element is closer to the first grounding portion than to the second grounding portion.

* * * * *